US006058199A

United States Patent [19]

Umitsu

[11] Patent Number: 6,058,199

[45] Date of Patent: May 2, 2000

[54] SPEAKER SYSTEM WITH VIBRATION ISOLATION SPEAKER UNIT MOUNTING STRUCTURE

[76] Inventor: Shigetomo Umitsu, 644-71 Futo-o-cho, Kohoku-ku, Yokohama 222-0031, Japan

[21] Appl. No.: 09/046,464

[22] Filed: Mar. 23, 1998

[51] Int. Cl.[7] ..... H04R 25/00

[52] U.S. Cl. ..... 381/395; 381/386; 181/151

[58] Field of Search ..... 381/307, 386, 381/345, 87, 332, FOR 151, FOR 165; 181/151, 146, 161, 166

[56] References Cited

U.S. PATENT DOCUMENTS

| | | | |
|---|---|---|---|
| 2,491,674 | 12/1949 | Markowitz | 181/31 |
| 3,740,056 | 6/1973 | Nuttal et al. | 274/9 B |
| 4,917,212 | 4/1990 | Iwaya | 181/141 |
| 5,298,693 | 3/1994 | Heijn | 181/199 |
| 5,769,787 | 6/1998 | Lemelson | 600/121 |
| 5,848,173 | 3/1996 | Sato et al. | 381/345 |

OTHER PUBLICATIONS

Tomiharu Yasuda, (Japanese Article)The Making of the RG–W1 System By Using Roller Support on a Unit, Radio Technigue Magazine, pp. 59–62, Apr. 1995.

Radio Gijutsu, Apr. 1995, pp. 59–62, "Manufacture of an RG–W1 System in Which the Loud Speaker Unit is Supported on Rollers", Tomiharu Yasuda (author).

*Primary Examiner*—Paul Loomis
*Assistant Examiner*—Dionne N. Harvey
*Attorney, Agent, or Firm*—Prince, Yeates & Geldzahler

[57] ABSTRACT

To prevent the generation of audible resonation of the baffle plate by rigid connection of the weighty speaker unit, the speaker system having a cabinet including a speaker unit uses a support structure which allows movement of the speaker unit in its axial direction, and a flexible seal member fitted into a gap formed between the baffle plate of the cabinet and the frame of the speaker unit or a sub-baffle connected to the frame of the speaker unit. In one embodiment, the support structure includes a swingable plate to which the speaker unit is fixed. A clamp device is provided to prevent movement of the movable part during the transportation of the speaker system.

25 Claims, 9 Drawing Sheets

SPEAKER SYSTEM WITH VIBRATION ISOLATION SPEAKER UNIT MOUNTING STRUCTURE

BACKGROUND OF THE INVENTION

1. Field of the Invention

The present invention generally relates to a speaker system having an enclosure in which at least a speaker unit is mounted.

2. Description of Related Art

Speaker systems are widely used as electroacoustic transducing devices in various audio systems such as home stereo systems, and audio-visual systems such as television sets.

To mount a speaker unit in a cabinet or enclosure, it is general to use screws or bolts in such a way that a plurality of screws are inserted respectively into a plurality of small holes perforated in the outer flange portion of a speaker frame, so that the flange portion is rigidly fixed to an edge portion of a mounting opening formed in the baffle plate.

In some cases, an additional reinforcement member is used to support the speaker unit in such a way to rigidly connect the speaker magnetic to the bottom, or base plate, of the cabinet.

This type of structure, however, has the drawback that complex vibration modes are generated by the rigid connection of the weighty speaker magnetic to the baffle plate of the cabinet, at the periphery of the speaker frame.

When a drive signal, such as a music signal, having impulse waveforms is supplied to a conventional speaker system having the structure described above, resonant sound components are produced in addition to the sound to be reproduced, especially during a rising edge or falling edge of an impulse sound component. These additional sound components are extremely detrimental for high-fidelity reproduction of original sound even though their sound pressure levels are by far lower than that of the sound to be reproduced.

An object of the present invention is therefore to provide a speaker system which can eliminate the generation of additional sound components caused by the resonation of the weighty speaker and the baffle plate of the speaker cabinet.

According to the present invention, there is provided a speaker system including at least a speaker unit, which comprises:

- a movable part including the speaker unit;
- a cabinet which houses the movable part including the speaker unit, and has a baffle plate in which an opening for receiving the speaker unit is formed, the opening capable of receiving at least a rear part of a frame of the speaker unit;
- a support device positioned in the cabinet for supporting the movable part including the speaker unit in a manner to allow a displacement of the speaker unit in an axial direction of the speaker unit; and
- a flexible seal member having an annular shape, fitted into a gap formed between the baffle plate and the movable part.

According to a second aspect of the invention, the speaker system further includes a clamping device for holding the movable part immovable with respect to the cabinet. The clamping device has a movable part connectable to the moving part when positioned in a holding position.

By the use of the holding device, the movable part of the speaker system can be held immovable during transportation.

BRIEF EXPLANATION OF THE DRAWINGS

Other objects and many of the attendant advantages of this invention will be readily appreciated as the inventive speaker system becomes better understood by reference to the following description when considered in connection with the accompanying drawings in which:

FIGS. 9 and 10 are front elevations of a support structure in a modification of the first embodiment with a clamping device, in which FIG. 10 shows the clamping bolt removed;

FIGS. 12–14 are plan views for explaining the structure of a third embodiment of the speaker system according to the present invention, in which FIG. 12 is a plan view of the speaker unit supported by a support frame, FIG. 13 is a plan view of the swingable plate 35 on which the support frame is mounted, and FIG. 14 is a plan view showing the inside of the cabinet in which the speaker unit 20 supported by the support frame mounted on the swingable plate 35 is placed;

FIGS. 15 and 16 are side elevational views of the support frame used in the fourth embodiment of the speaker system according to the invention in which FIG. 15 is a side elevation viewed when the axis of the speaker unit lies horizontally, and FIG. 16 is a side elevation viewed when the direction of the speaker unit is inclined downwardly;

DETAILED DESCRIPTION OF PREFERRED EMBODIMENTS

Before entering into the description of the embodiments of the present invention, an example of conventional speaker system is particularly described with reference to FIGS. 1 to 3 of the accompanying drawings.

Figure 1:
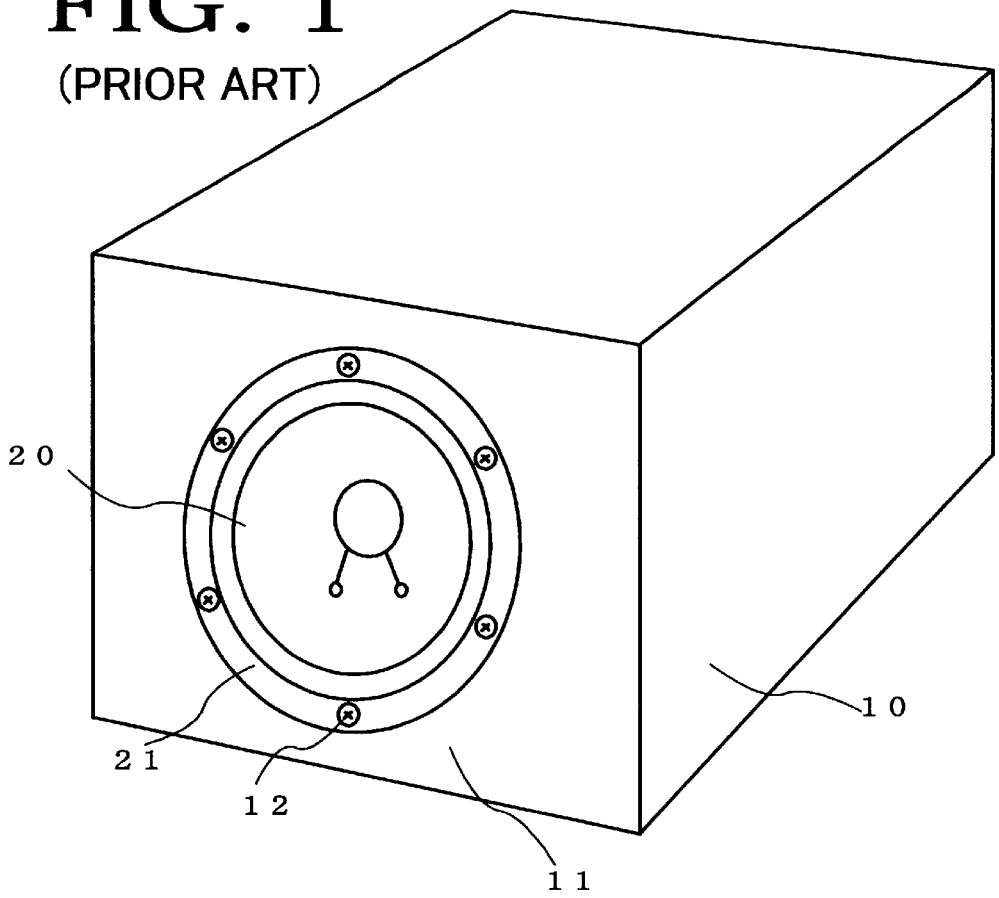
FIG. 1 (PRIOR ART)
FIG. 1 is a perspective view showing the appearance of a conventional speaker system.

As shown in FIG. 1, a speaker unit 20 is mounted in a cabinet 10, through an opening formed in a baffle plate 11 of the cabinet 10. As shown in FIG. 2 in which the cabinet 10 is shown in vertical cross-section, the speaker unit 20 is mounted in such a way that its frame 22 and magnetic circuit 24 connected thereto are inserted into an opening formed in the baffle plate 11. The reference numeral 13 denotes a base plate or bottom plate, and the reference numeral 14 denotes a top plate of the cabinet.

The speaker unit 20 includes a cone 23 to which a voice coil inserted into the magnetic circuit 24 is connected. A flange portion 21 of the frame 22 is fixed to a circular edge portion of the baffle plate at its opening by means of a plurality of screws 12. The plurality of screws are inserted respectively into a plurality of small holes perforated in the flange portion 21 of the frame 22, so that the flange portion 21 is rigidly fixed to the baffle plate 11 by means of the pressure given by the screw heads.

Figure 2:
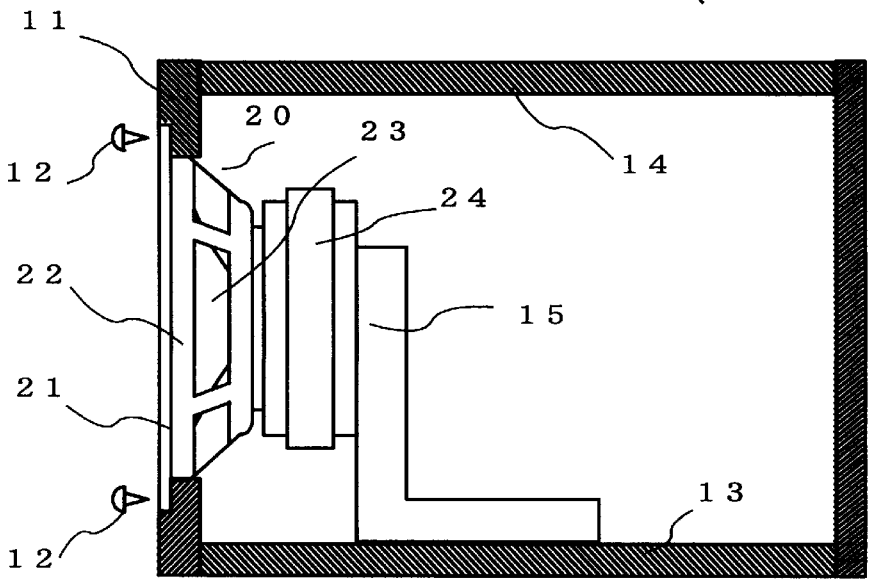
FIG. 2 (PRIOR ART)
FIG. 2 is a diagram showing the manner of mounting a speaker unit in a cabinet of the speaker system shown in FIG. 1, in which the cabinet is depicted in cross-section.

In some cases, an additional reinforcement member 15, shown by the chain line in FIG. 2, is used to support the speaker unit in such a way to rigidly connect the magnetic circuit of the speaker unit to the base plate 13 of the cabinet 10.

As mentioned before, this type of structure, however, has the drawback that complex vibration modes are generated by the rigid connection of the weighty magnetic circuit 24 of the speaker unit 20, and are transmitted to the baffle plate 11 of the cabinet 10, at the periphery of the frame.

Hereinafter, the embodiments of the speaker system according to the present invention will be described with reference to FIGS. 3 through 20.

Figure 3:
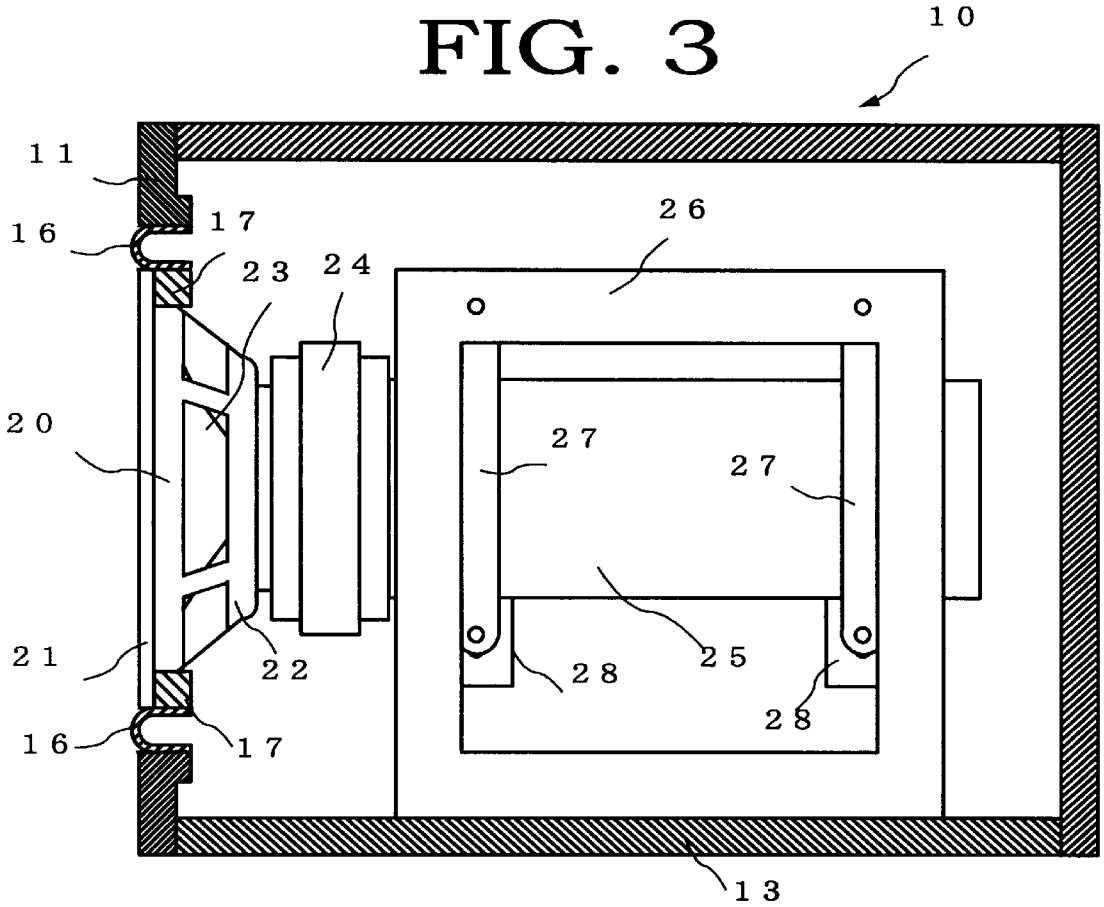
FIG. 3 is a diagram showing the support structure of a speaker system used in the first embodiment of the speaker system according to the present invention.
Figure 4:
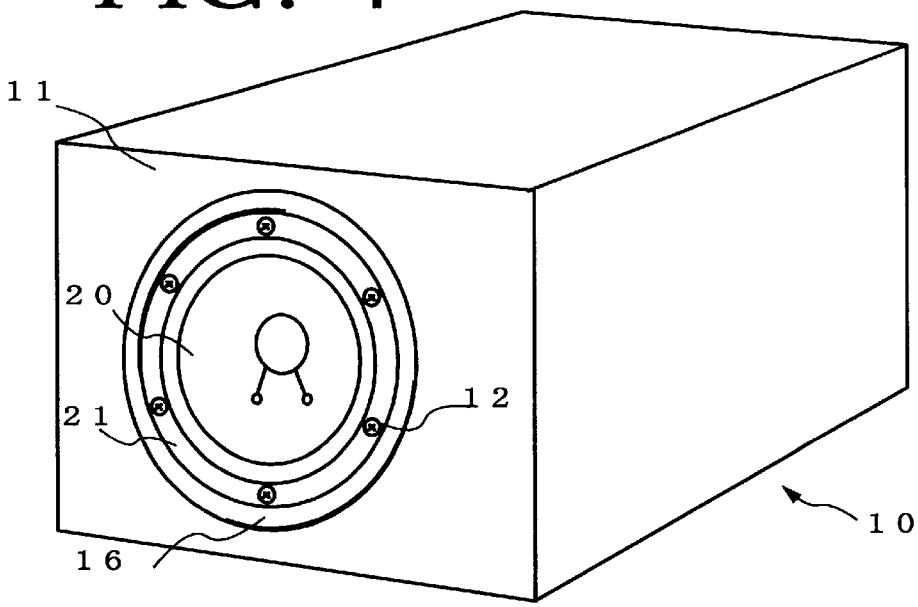
FIG. 4 is a perspective view of the first embodiment of the speaker system according to the present invention whose structure is shown in FIG. 3.

FIG. 3 is a diagram similar to FIG. 2, in which the structure of a first embodiment of the speaker system according to the present invention is illustrated. The same reference numerals as those in FIG. 2 are used to denote corresponding parts. FIG. 4 shows the appearance of the speaker system having the structure shown in FIG. 3.

As shown in FIGS. 3 and 4, the diameter of the round opening formed in the baffle plate 11 of the cabinet 10 is made larger than the diameter of the frame 22 of the speaker 20 so that a gap of a ring shape is formed between the outer periphery (flange portion 21) of the frame 22 and the inner circular edge of the baffle plate 11 around its opening. At the position of the ring-shaped gap, a flexible seal member 16 having a general ring shape is placed to provide an air-tight connection between the frame 12 and the baffle plate 11.

As shown in FIG. 3, the flexible seal member 16 in this example is fixed to the frame 22 of the speaker unit 20 at its inner periphery, and is fixed to the baffle plate 11 at its outer periphery by using an adhesive for example. The flexible seal member 16 has a U-shaped cross-section by which the relative movement of the frame 22 and the baffle plate 11 is permitted by a shift of the round part of the U-shaped cross-section. In this example, a ring-shaped spacer member 17 having the same diameter as the frame 22 is place behind the flange portion of the frame 22 and connected thereto by means of screws 12, so as to increase the area of the cylindrical part of the frame 22 to which the flexible seal member 16 is fixed.

The flexible seal member 16 may be made of any of suitable materials such as, rubber, a flexible resin such as polyurethane, or a textile with an air-tight film on its surface or coated with a viscous material. Also, the entire shape and the form of the cross-section of the flexible seal member 16 are not limited to the above-described example, and its further examples will be described later.

Figure 7:
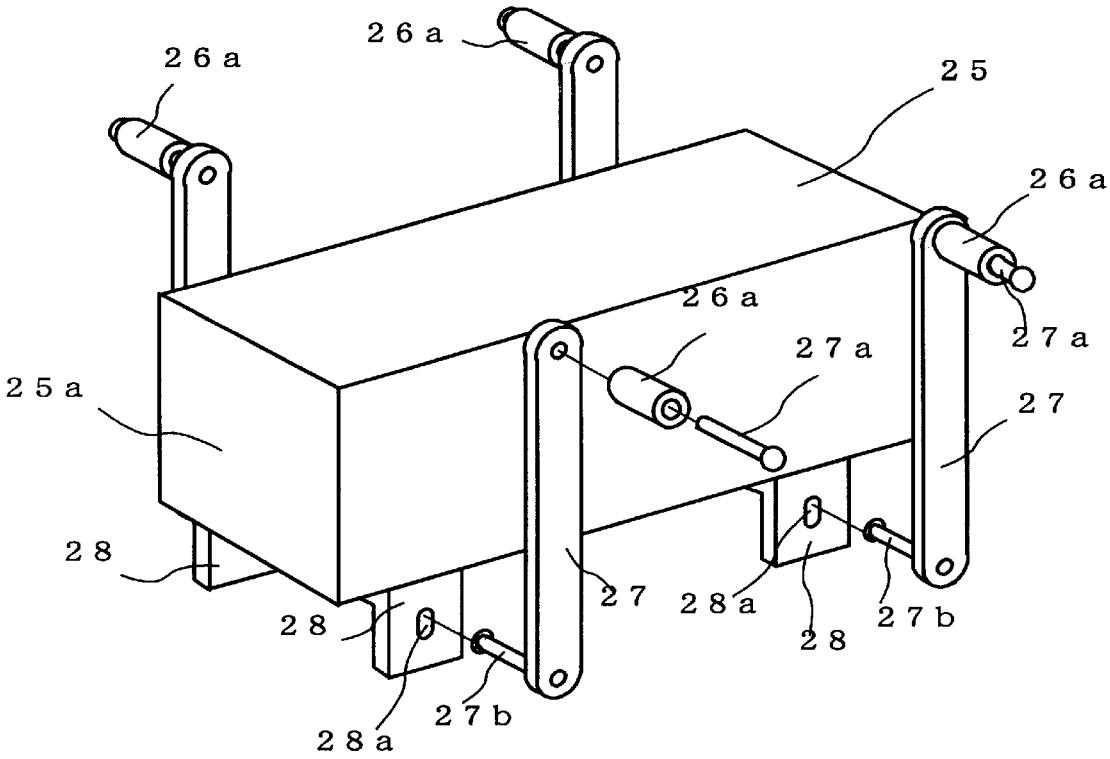
FIG. 7 is a partially exploded perspective view of the supporting links 27 of the rear extension block 25 used in the first embodiment of the invention shown in FIGS. 3 and 4.

Referring back to FIG. 3 and referring to FIG. 7, a rear extension block 25 is fixed to the rear face of the speaker unit 20 so that the center axis of the cylindrical voice coil (not shown) of the speaker unit 20 passes through it. The rear extension block 25 is suspended in a space formed by a box-shaped frame 26 by means of four link rods 27, each of which has an upper end rotatably connected to an upper part of the frame 26 and a lower end which also rotatably connected to the bottom of the rear extension block 25 through a bracket 28. Thus, the rear extension block 25 moves as a pendulum whose axis of elongation always lies horizontally. The details of this support mechanism will be further described with reference to FIG. 7.

The link rods 27 are preferably made of an FRP (Fiber Reinforced Plastic) so that it is tenacious enough to support the heavy rear extension block 25 and the speaker unit 20 connected thereto. The frame 26 is placed on the bottom plate 13 of the cabinet, and fixed thereto by means of suitable parts such as screws or adhesive. By this structure, movement of the rear extension block 25 relative to the frame 26 is permitted, and is guided by the rotation of the link rods 27. The rear extension block 25 may be made of a heavy material such as a metal or an earthen material, so as to obtain a large inertial mass. In this example, the rear extension block 25 comprises a metal block and a wooden box containing it which in turn is connected to the rear face of the magnetic circuit 24 of the speaker unit 20 by means of adhesive, so that the speaker unit 20 and the rear extension block 25 constitute an integral part whose direction of movement is effectively limited to the axial direction of the speaker unit when the amplitude of the oscillation of the link rods 27 caused by its movement is small.

By suspending the rear extension block 25 on the frame 26, the speaker unit 20 is stably supported on the frame 26 even if the frame 22 of the speaker unit 20 is totally disconnected from the baffle plate 11 of the cabinet 10. With this construction, the flexible seal member 16 does not bear the weight of the speaker unit 20 at all, but is only effective for the positioning of the speaker unit 20 along its axial direction. Since the flexible seal member 16 asserts a resisting force against deformation, to maintain its original form of its cross-section, the speaker unit 20 and the rear extension block 25 connected thereto are maintained at their neutral positions shown in FIG. 3 at which the link rods 27 are vertical, unless any external force is applied to through the frame 22 of the speaker unit 20.

When a drive signal is supplied to the voice coil of the speaker unit 20, its cone 23 moves back and forth to create acoustic waves corresponding to the drive signal. As a result of the movement of the cone, a repulsive force is applied to the magnetic circuit 24 of the speaker unit 20, so that it vibrates slightly due to its large inertial mass relative to that of the cone 23. In the case of a conventional structure, the vibration of the magnetic circuit 24 is transmitted to the cabinet 10, and especially to the baffle plate 11 through the frame 22 connected thereto, so that the additional vibration tones mentioned before are generated. Conversely, according to the present invention, the vibration of the magnetic circuit 24 is totally isolated from the cabinet 10 by means of the support structure which, for example, includes the frame 26 and link rods 27 shown in FIG. 3. Additionally, the use of the rotatable link rods creates a harmonic oscillation whose frequency is effectively determined by the lengths of the link rods. However, when the length of the link rods 27 is about 10 centimeters, the period of its harmonic oscillation is about 0.63 second (according to an equation of:

$$2\pi \times \sqrt{1/g}$$

where l represents the length of the pendulum and g represents acceleration of gravity, i.e. about 1.58 Hz), so that no significant change is caused for the reproduction of an audio signal whose frequency range is generally between 20 Hz to 20 kHz. In practice, substantially no movement of the speaker unit 20 is produced by the application of a drive signal, and one can feel substantially no vibration when touching the frame 22 of the speaker unit 20 arranged according to the present invention when a loud sound is being reproduced by the speaker system.

Figure 5:
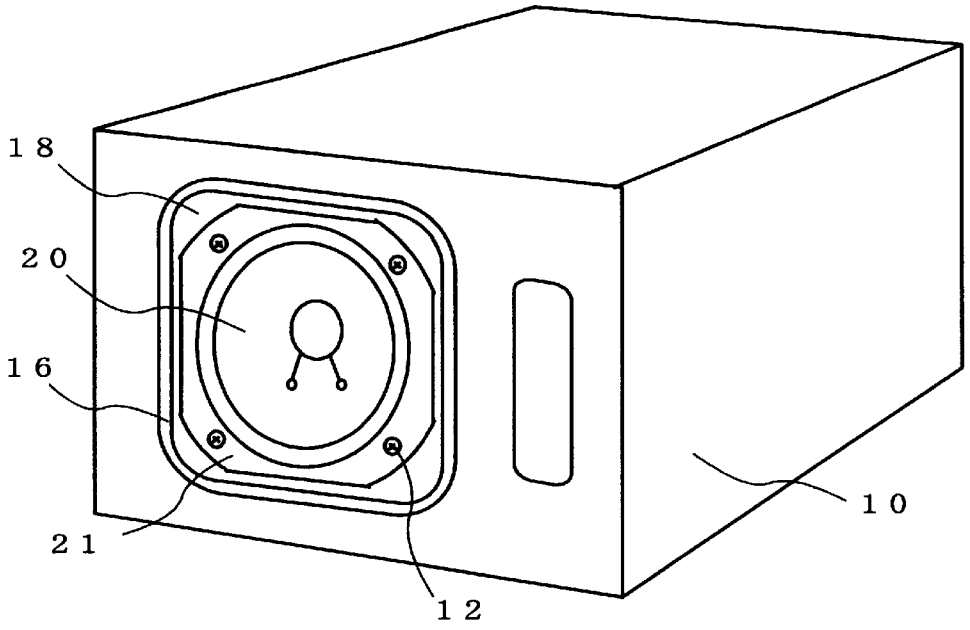
FIG. 5 is a perspective view of a second embodiment of the speaker system according to the invention in which a sub baffle plate is connected to the frame of the speaker unit.

Turning to FIG. 5, there is shown a modification of the embodiment shown in FIGS. 3 and 4, in which a sub-baffle 18 having a square form with round corners is used. A round opening is formed in the sub-baffle 18, and the speaker unit 20 is fixed to the sub-baffle 18 through its round opening in a usual manner by means the screws 12. The size of the opening formed on the front baffle 11, which has a form corresponding to the shape of the sub-baffle 18, is slightly larger than the size of the sub-baffle 18, so that a gap similar to the gap shown in FIG. 4 is formed between the outer periphery of the sub-baffle 18 and the inner edge portion of the opening formed in the baffle plate 11. At the position of this gap portion, the flexible seal member 16 is placed in a similar manner as explained with reference to FIG. 3.

In this embodiment, the speaker system can be commonly used for various types of speaker units by preparing a plurality sub-baffles having different sizes and shapes of openings corresponding to the speaker units to be mounted. Furthermore, more than one speaker unit may be mounted on a single sub-baffle, in such a way that at least one or all of the speaker units mounted thereon are supported by the support structure as illustrated in FIG. 3 or any of the support structures which will be described later. If fewer than all of the mounted speakers are supported by such a structure, the rest of the speakers are simply supported by the sub-baffle. In that case also, the isolation of vibration between the baffle plate of the cabinet and the speaker units is accomplished, so that generation of additional tones by the resonation of the baffle plate and the speaker units is prevented.

Figure 6A:
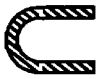
FIGS. 6A through 6J are cross-sectional views showing various forms of the flexible seal member used in the speaker system according to the present invention.
Figure 6B:
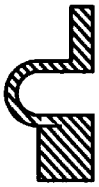
Figure 6C:
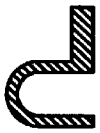
Figure 6D:
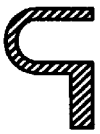
Figure 6E:
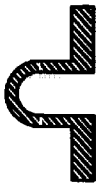
Figure 6F:
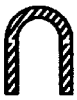
Figure 6G:
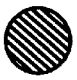
Figure 6H:
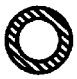
Figure 6I:
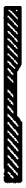
Figure 6J:
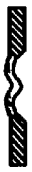

FIGS. 6A through 6J show variations of the form of the cross-section of the flexible seal member 16. FIG. 6A shows an enlarged cross-section of the flexible seal member 16 shown in FIGS. 3, 4 and 5. The cross-section shown in FIG. 6B, on the other hand, is characterized in that a part having a square or rectangular cross-section is formed continuously at each of the ends of the part having the U-shaped cross-section shown in FIG. 6A. By the provision of these additional portions, the spacer member 17 shown in FIG. 3 need not be used. FIGS. 6B through 6D show further examples, in which the flexible seal member 16 has at least one additional portion formed integrally with an end of the part having the U-shaped cross-section, in order to facilitate its fixing to the frame 22 and the edge portion the opening of the baffle plate 11. The flexible seal member 16 whose cross-section is shown in FIG. 6F is characterized in that its front and rear ring shaped parts are connected together to form the U-shaped cross-section, and is placed at the position of a gap formed behind the flange portion 21 of the frame 22 when the diameter of the flange portion 21 is slightly larger than the diameter of the opening formed in the baffle plate 11 and the flange portion 21 is positioned before the baffle plate 11. The flexible seal member whose cross-section is shown in FIGS. 6G or 6H has a round outer form so that it is easily inserted into the gap between the flange portion 21 of the frame 22 and the edge portion of the opening of the baffle plate 11. The planer flexible seal member shown in FIG. 8H or FIG. 8I may be used to cover the gap portion from the front or rear face of the baffle plate 11. The selection from among the cross-sections depicted in FIGS. 6A through 6J is preferably made depending on the form of the frame 22 of the speaker unit 20 to be mounted in the cabinet 10.

FIG. 7 is a perspective view of the rear extension block 25 which is supported in the box-shaped frame 26. (The speaker unit connected to the front face 25*a* of the rear extension block 25 as shown in FIG. 3 is not shown.) As previously described with reference to FIG. 3, four link rods 27 are used to support the rear extension block 25, each of which is provided with upper and lower pins 27*a* and 27*b* respectively at its upper and lower ends and on opposite sides. The pins 27*a* and 27*b* are connected to the link rod 27, so as to project at right angles with respect to the surface of the link rod 27.

The upper pin 27*a* is received in a sleeve 26*a* which in turn is positioned in a hole (not shown) provided at an upper part of the box-shaped frame 26 (shown in FIG. 10), so that rotation of the link rod 27 relative to the frame 26 about the rotation axis defined by the upper pin 27*a* is permitted.

The lower pin 27*b*, on the other hand, is received in an opening 28*a* which preferably has an elliptical or elongate form (its purpose will be described in connection with a modification shown in FIGS. 9 and 10) provided in a vertical portion of the bracket 26 connected to the bottom of the rear extension block 25. The opening 28*a* may have a circular form if the feature which will be described later is not necessary. With this structure, the rear extension block 25 is supported by the four link rods 27 by the engagement between the lower pins 27*b* of the link rods 27 with the openings 26*a* of the four brackets 26 connected to its bottom face. When a force in the horizontal direction perpendicular to the directions of the upper and lower pins 27*a* and 27*b* is applied to the rear extension block 25, relative movement between the rear extension block 25 and the frame 26 is allowed by the rotation of the link rods 27, so that any vibration in this direction which are transmitted to the rear extension block 25 is efficiently absorbed by the mechanism formed by the link rods 27 and the frame 26.

Figure 8:
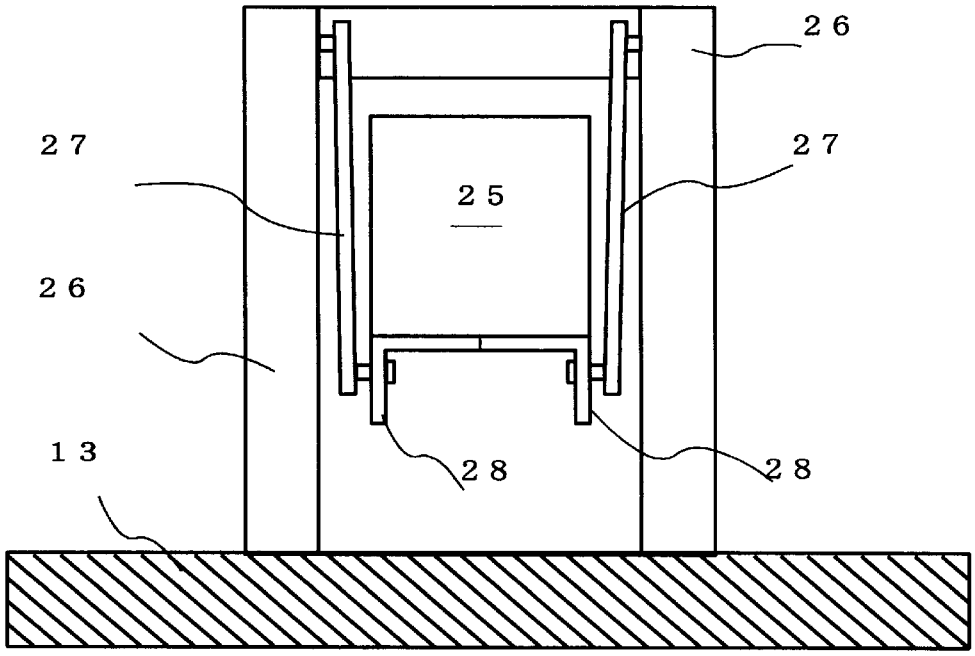
FIG. 8 is a front elevational view of the support frame 26 in which the rear extension block 25 is suspended by the link rods 27.

FIG. 8 is a front view of the rear extension block suspended by the box-shaped frame 26 which is placed on the base plate 13 of the cabinet 10. As depicted in FIG. 8, the distance between the upper ends of each pair of link rods 27, which are positioned at the same distance from the front end of the rear extension block 25, is slightly larger than the distance between their lower ends.

This configuration is effective to quickly stabilize any lateral (sideways in FIG. 8) oscillation of the rear extension block because lateral displacement of the rear extension block 25 will result in its rotation about its axis of elongation, which in turn will be restricted by the resilient force produced by the flexible seal member 16 connected to the flange portion 21 of the frame 2 of the speaker unit 20 connected thereto.

Although the link rods 27 are supported by the box-shaped frame 26 in the above-described example, any suitable support structure by which the link rods 27 are suspended can be used instead of the frame 26. For instance, a shaft for rotatably supporting each of the link rods 27 may be directly connected to the side wall or the top plate of the cabinet 10.

Figure 9:
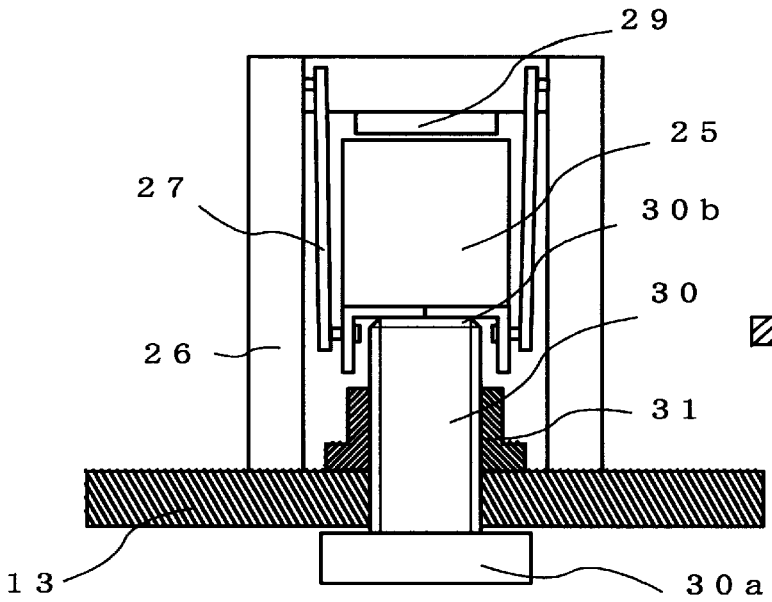
Figure 10:
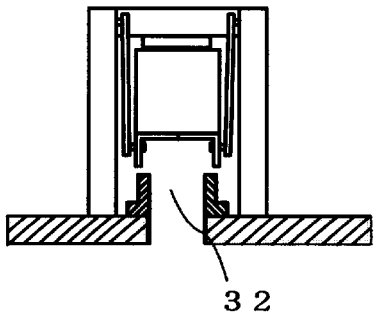

FIGS. 9 and 10 show a modification of the mechanism shown in FIGS. 3, 7 and 8, which includes a clamping device for preventing movement of the speaker unit 20 and the rear extension block 25 connected together during the transportation of the speaker system. The clamping device includes an upper clamp piece 29 having a bottom surface connected to the upper part of the frame 26 so that a small gap is formed between the upper face of the rear extension block 25 supported by the link rod 27 and its bottom surface. At a position beneath the upper clamp piece 29, a clamping bolt 30 having a relatively large diameter is upwardly inserted into the opening formed by a bass-reflex duct 31 which is connected inside the base plate 13 of the cabinet The cylindrical inner surface of the bass-reflex duct 31 is threaded so that the clamping bolt 30 is screwed thereinto by rotating the head part 30*a* thereof. When the clamping bolt 30 is fully screwed into the bass-reflex duct 31, its upper tip 30*b* pushes up the rear extension block 25 against the upper clamp piece 29. In this way, the rear extension block 25 and the speaker unit 20 connected thereto can be firmly clamped between the upper clamp piece 29 mounted on the frame 26 and the clamping bolt 30 inserted into the bass-reflex duct 31 when necessary, for example, during the transportation of the speaker system. In this clamping position, a slight upward movement of the rear extension block 25 is permitted by a downward relative movement of the lower pin 27*b* in the elliptical or elongate opening 28*a* of the bracket 28, shown in FIG. 7.

When the clamping bolt 30 is un-screwed and removed, the space inside the the bass-reflex duct 31 is opened as illustrated in FIG. 10, so that the frequency components of the drive signal acoustically tuned by the bass-reflex duct 31 are radiated from the opening 32 formed in the base plate 13 of the cabinet 10. In this embodiment, it is preferable to use a speaker stand to support the cabinet 10 to secure a propagation path of the tuned bass sound.

FIG. 26 shows a second embodiment in which two vibration isolation members 33 are used to support the rear extension block 25. Each vibration isolation member 33 is made of any of material such as a resin, a rubber, or a textile, and has a general rectangular form in which a rectangular opening for receiving the rear extension block 25 is formed. For instance, I.D.S.C. (Isolation Damping Specialty Composite) marketed by the J-1 Project Corp. can be used for the vibration isolation member 33. The four side surfaces of the vibration isolation member 33 are surrounded by sides of a support frame 34 having a square form, positioned on the base plate 13 of the cabinet 10.

By this structure, the movement of the rear extension block in its longitudinal direction is allowed, and also vibration is efficiently absorbed. The forms of the vibration absorption members 33 and the support frames 34 are not limited to the illustrated example. For instance, a pair of vibration isolation members each having a simple rectangular form, and arranged on a support plate may be used to support the rear extension block 25 at its lower surface.

Figure 12:
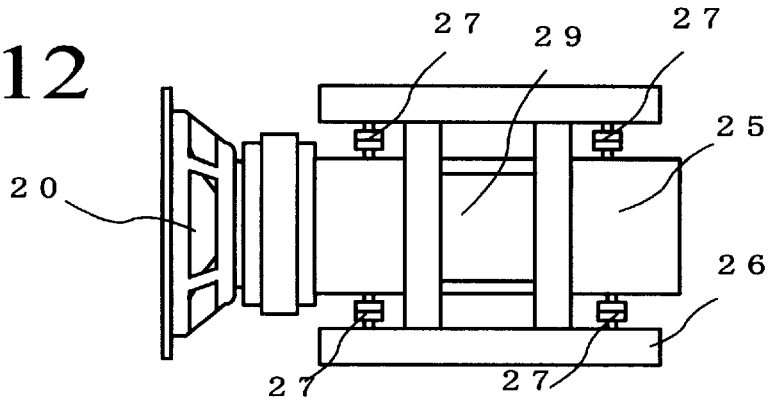
Figure 13:
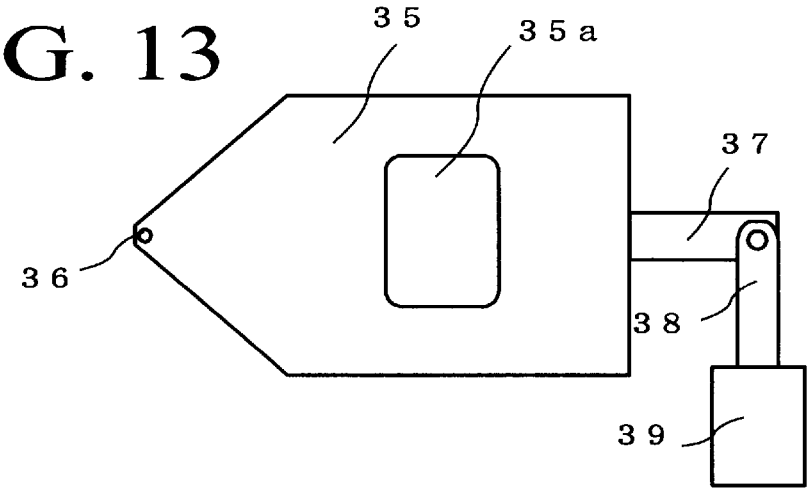
Figure 14:
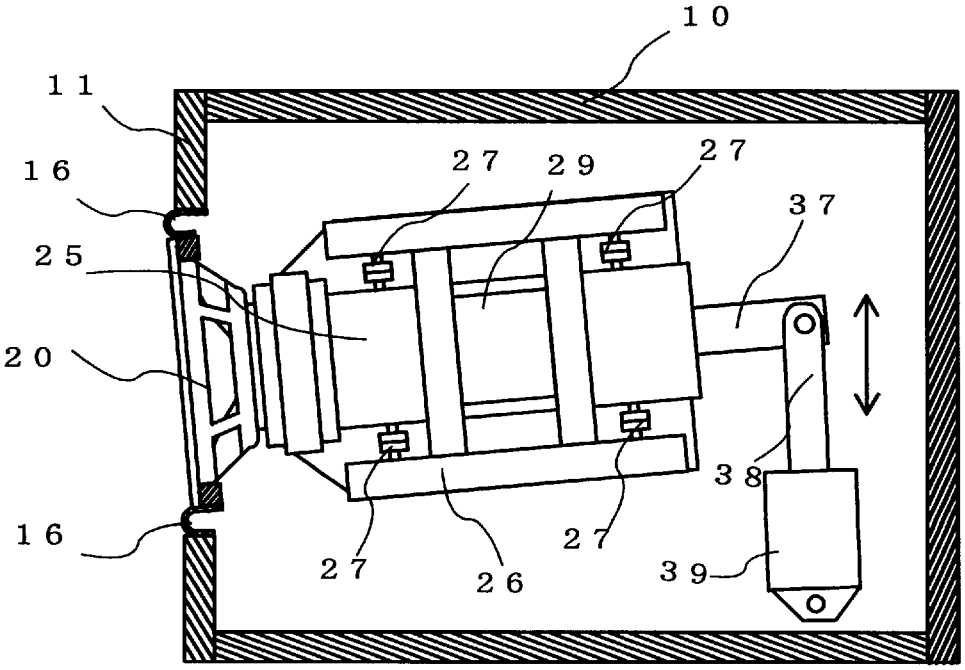

FIGS. 12 through 14 show a third embodiment which features that the speaker unit 20 housed in the cabinet 10 can be angularly shifted in the horizontal plane for the purpose of improving the listening status without regard to the direction of the speaker unit.

Generally, the frequency response of a speaker unit gradually degrades, especially in the high frequency range, corresponding to a shift of the listening position from the center axis of the speaker unit. To improve the quality of the speaker sound, it is desirable to angularly shift the position of the speaker system from a normal position in which left and right speaker systems are placed in parallel with each other, to a position in which the baffle plate faces more directly to the listener.

According to the present invention, the quality of the sound being listened to can be improved without changing the positioning of the speaker system itself, since the speaker unit housed in the cabinet can be angularly shifted independently of the cabinet in which the unit is mounted. Therefore, it is possible to shift the angular position of the speaker unit to improve the listening quality while the position of the cabinet is unchanged.

To enable the angular shift of speaker unit 20 and the rear extension block 25 connected thereto relative to the cabinet 10, the frame 26 supporting them, which is illustrated in the plan view of FIG. 12, is mounted on a swingable plate 35 placed on the base plate 13 of the cabinet 10, as illustrated in FIG. 13. In the case of the illustrated example, the swingable plate 35 has a pentagonal shape and an opening 35*a* is formed to allow the bass-reflex duct 31 to pass through it. The swingable plate 35 is placed on the base plate 13 of the cabinet 10 so that it is rotatable about a stud pin 36 which is planted on the base plate 13 at a position close to the baffle plate 11. The swingable plate 35 has a small hole at its acute head position, to receive the stud pin 36. To cause an angular shift of the swingable plate 35, a projection 37 is fixed thereto at the rear of the plate 35 opposite the position of the stud pin 36, and a push/pull rod 38 of a drive mechanism 39 is rotatably connected to an end of the projection 37. Preferably, the drive mechanism 39 includes a motor or a solenoid to move the push/pull rod 38 in its axial direction in accordance with a drive signal supplied thereto from a remote control unit. The drive mechanism 39 is also rotatably mounted on the base plate 13 of the cabinet so that it allows a slight angular shift which is produced as the movement of the push/pull rod 38 which in turn is connected to the projection 37 of the swingable plate 35.

Instead of using the electrically controlled drive mechanism 39 described above, it is also possible to use a longer push/pull rod whose other end is exposed outside the cabinet 10 so that the user can manually shift the position of the swingable plate 35 by axially moving the end of the push-pull rod. Furthermore, it is also possible to use a cam mechanism including a rotatable knob which is positioned on the side of the cabinet and configured to shift the axial position of the push/pull rod by the rotation of the rotatable knob.

As illustrated in FIG. 14, the speaker unit 20 is angularly shifted by the movement of the swingable plate 35, which is caused by the axial movement of the push/pull rod 38 as indicated by the arrow in the figure. In this angularly shifted state of the speaker unit 20, the flexible seal member 16 is slightly deformed in the manner that a relative displacement of the inner and outer peripheral edges facing each other (corresponding to the leg portions of its U-shaped cross-section) is generated especially in the right and left sides of the frame 22 of the speaker unit 20. This, however, does not produce any obstacle to the axial movement of the speaker unit 20 supported through the rear extension block 25.

Figure 11:
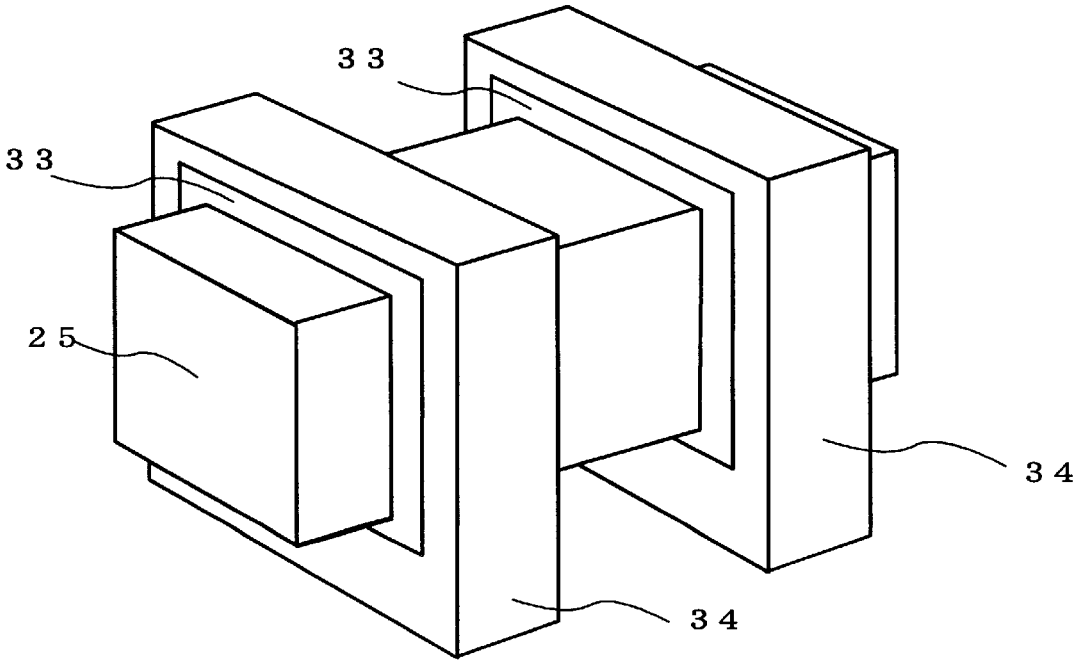
FIG. 11 is a perspective view of a support structure used in a second embodiment of the speaker system according to the present invention.

Although the support mechanism comprised of the frame 26 and the link rods 27 is mounted on the swingable plate 35 in the example shown in FIGS. 12–14, it is also possible to mount another support structure, for example the structure shown in FIG. 11 on the swingable plate 35. It is also possible to form the frame 26 and the swingable plate 35 as a single integrated body using a plastic material.

Figure 15:
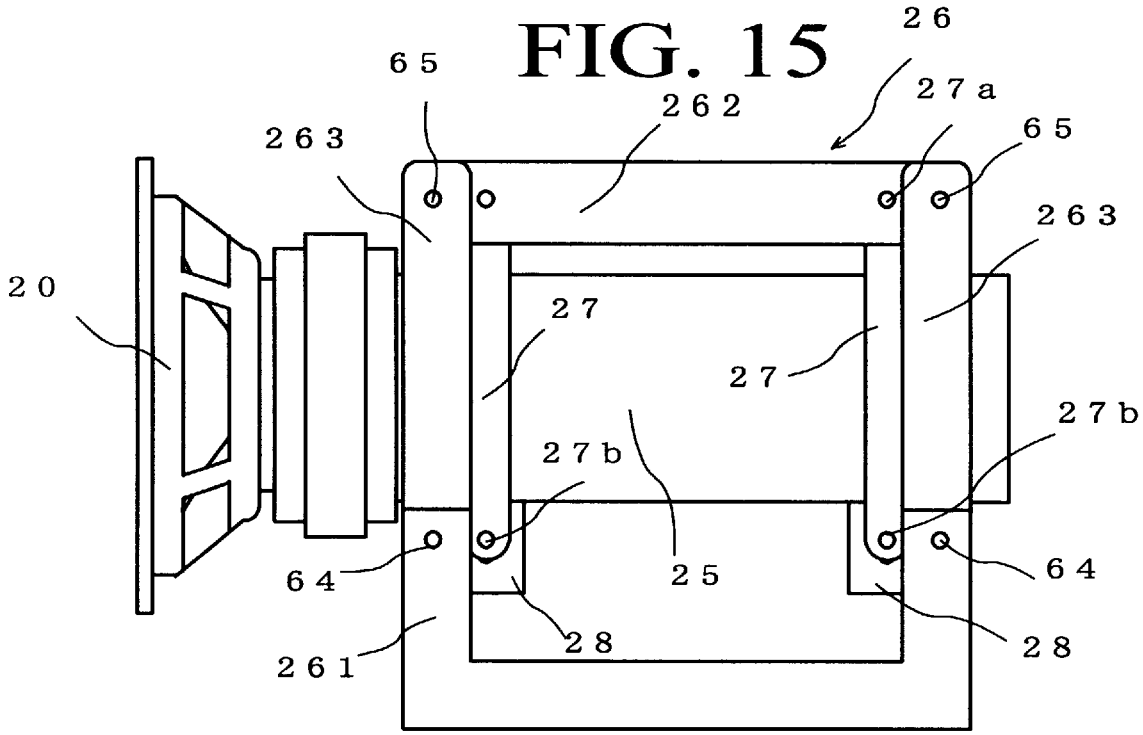
Figure 16:
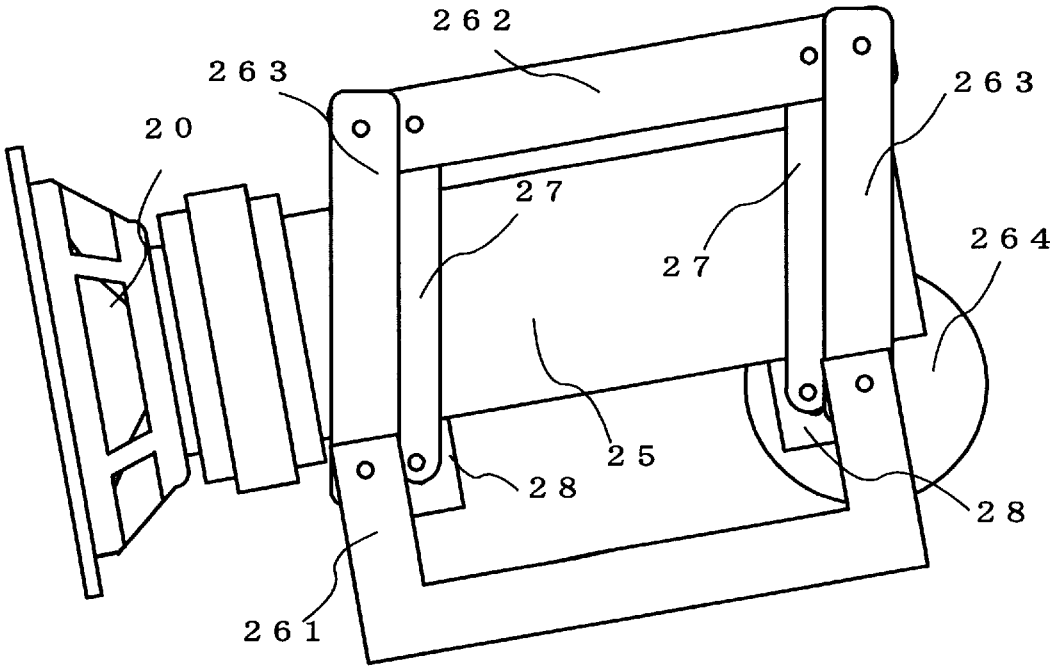

FIGS. 15 and 16 show a fourth embodiment of the speaker system according to the present invention in which a support structure similar to that shown in FIG. 3 is employed. This embodiment features that the cabinet 10 of the speaker system can be installed in a manner that it is inclined with respect to a horizontal plane, so that the speaker unit faces a upward or downward shifted direction.

If the speaker system using the frame 26 shown in FIG. 3 is inclined in the manner as depicted in FIG. 16, the speaker unit 20 and the rear extension block 25 connected thereto are moved forward and the speaker unit 20 projects from the baffle plate 11 of the cabinet 10.

To prevent this movement, the frame 26 in this embodiment is formed by a base portion 261 and an upper movable portion 262 which are supported by four parallel connection members 263, that is, two pairs of connection members 263 which are provided on both sides of the support frame 26, respectively.

Each of the four parallel connection members 263 is rotatably supported about a pivot shaft 64 on the base portion 261 which is at the same height level as that of the lower connection pins 27*b* of the link rods 27 shown in FIG. 3. The upper movable portion 262 is supported at upper end portions of the four parallel connection members 263 respectively by means of parallel shafts 65 arranged at the height position as that of the upper pin 27*a* of the link rod 27, and in a direction perpendicular to the plane of the figure. With this structure, the upper movable portion 262 of the frame 26 is maintained in horizontal position when the four parallel connection members 263 are all rotated relative to the base portion 261. In the same manner as that shown in FIG. 7, each of the four link rods 27 is supported by using the upper pin 27*a* connected thereto and the sleeve 26*a* which is inserted into a hole formed in the upper movable portion 262, at the same height level as the corresponding hole of the frame 26 shown in FIG. 3, when the four parallel connection members 263 are placed in upright positions as illustrated in FIG. 15.

Since the four parallel connection members 263 and the link rods 27 have the same effective length by the arrangement as described above, the position of the brackets 28 supported by the lower ends of the link rods 27 can be maintained unchanged relative to the cabinet 10 by rotating the four parallel connection members 263 in the same degrees as a rotation of the link rods 27 which will be caused by the gravity when the cabinet 10 is inclined as illustrated in FIG. 16. To hold the upper movable portion 262, frictional connection is made between the four parallel connection members 263 and the base portion 261, and/or between the four parallel connection members 263 and the upper movable portion 262. Furthermore, a drive shaft having a rotation knob 264 positioned outside the cabinet 10 is fixed to at least one of the four parallel connection members 263 at its lower pivot end. With this structure, the position of the speaker unit 20 can be manually adjusted by shifting the position of the upper movable portion 262 of the frame by means of the rotation knob 264, as illustrated in FIG. 16.

Figure 17:
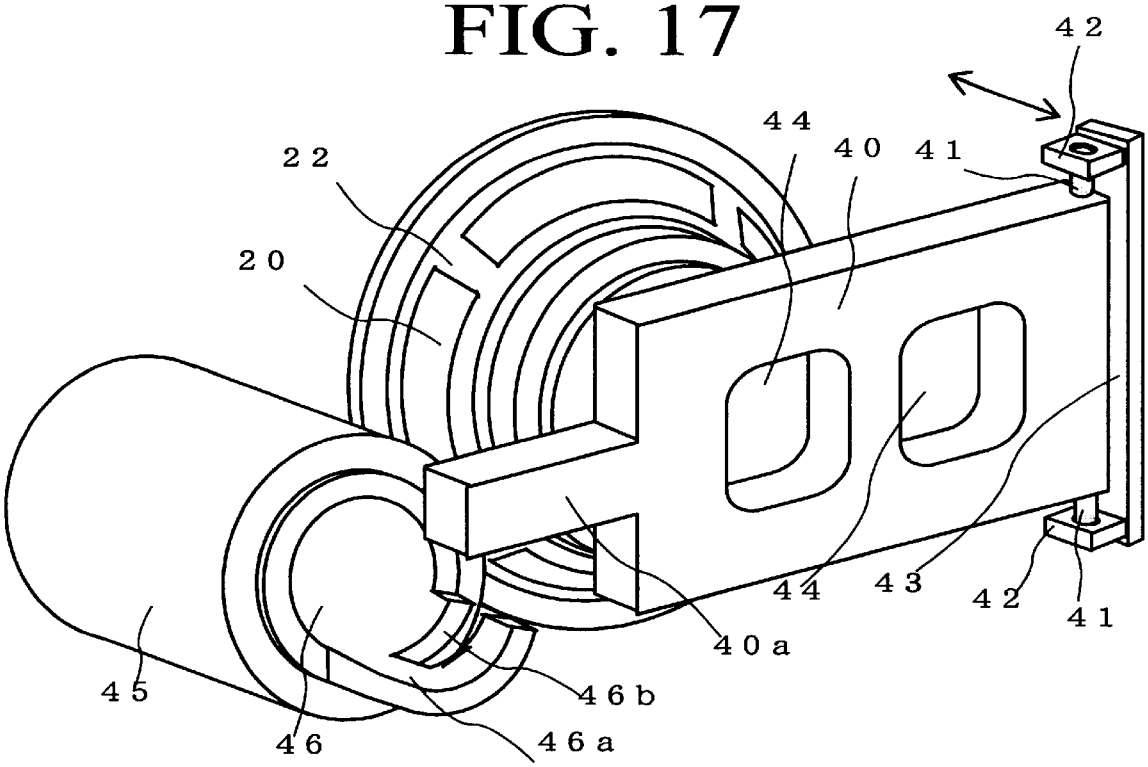
FIG. 17 is a perspective view of the support structure used in a fifth embodiment of the speaker system according to the invention.

FIG. 17 shows a fifth embodiment of the speaker system according to the present invention in which a swing plate 40 is rotatably provided in the cabinet 10, and is used to support the speaker unit 20. In this fifth embodiment, the flexible seal member 16 is provided around the frame 22 of the speaker unit 20 in the similar manner as that shown in FIG. 3. Since only the support mechanism is different from that shown in FIG. 3, explanation will be made to the depicted support structure only.

The swing plate 40 is connected to the rear face of the magnetic circuit 24 of the speaker unit 20 in the similar manner as the rear extension block shown in FIG. 3, and is supported to be rotatable about a vertical axis which is provided near a side wall (not illustrated for the purpose of the clarity of the figure) of the cabinet. In the illustrated example, a pair of support pins 41 extending in the vertical direction are provided at positions near the upper and lower side corners of the swing plate 40 and are supported by a pair of brackets 42 each having a reception hole. The brackets 42 are mounted on a support plate 43 which may be connected to the side wall of the cabinet, or connected to an appropriate vertical member positioned on the base plate 13 of the cabinet. The essential point is that the swing arm plate 40 is rotatably supported on a vertical axis which is located away from the center axis of the speaker unit, and one of various types of rotatable support, for example, those including a ball or roller bearing, can be used for this purpose.

Because of the freely rotatable arrangement of the swing plate 40, the movement of the speaker unit 20 can be regarded to be within its axial direction when the rotation angle of the swing plate 40 is small. Since axial movement of the speaker unit 20 is allowed, the improvement of the sound reproduction is also attained with this embodiment. In this embodiment, the inertial moment of the part constituted by the speaker unit 20 and the swing plate 40 increases as the distance between the vertical support axis and the center axis of the speaker unit 20 increases. To further increase the inertial moment, a weight may be mounted behind the speaker unit 20 in such a manner as to sandwich the swing plate. In order to reduce reflections of the sound wave in the cabinet, and to prevent the generation of a standing wave, the swing plate 40 is provided with openings 44 at its center position.

Furthermore, by shifting the position of the support brackets 42 in the direction indicated by the arrow in FIG. 17, the direction of the speaker unit 20 at its neutral position can be shifted to improve the sound reproduction, as in the case of the third embodiment shown in FIGS. 12 through 14. In the example shown in FIG. 17, the swing plate has a projection 40*a* at the position farthest from the support pins 41. The projection 40*a* of the swing plate 40 is engageable with a projected part 46*a* of a cylindrical member 46 fitted to the inside wall of a cylindrical bass-reflex duct 45. In an engaged state, the projection 40*a* is received in a notch or recessed portion 46*b* provided at the projected part 46*a*, and these parts can be disengaged by rotating the cylindrical member 46 in the bass-reflex duct 45 from outside the cabinet 10 (not illustrated in FIG. 17).

In a manner similar to that explained with reference to FIGS. 9 and 10, undesirable movement of the speaker unit 20 supported by the swing plate 40 can be prevented by the engagement between the projection 40*a* and the projected part 46*a* of the cylindrical member 46 before the speaker unit is installed in the position at which the reproduction of sound is performed. After installation is complete, the user of the speaker system can release the swingable member 40 to its freely movable state in which the movement (rotation about the vertical axis) of the speaker unit 20 is restricted only by the flexible seal member.

Figure 18:
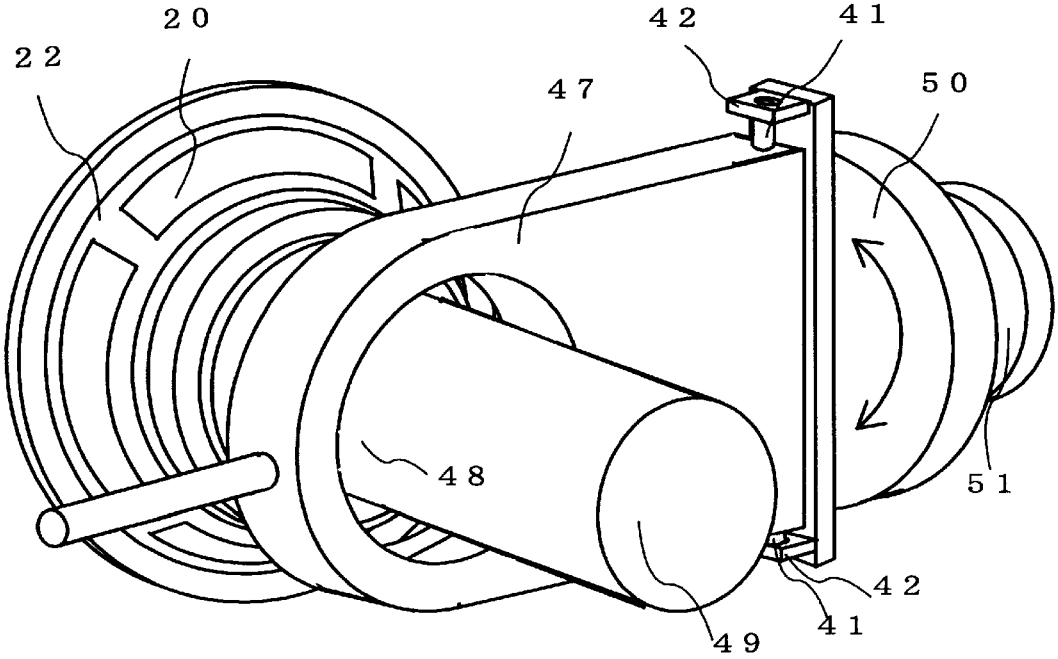
FIG. 18 is a perspective view of the support structure used in a sixth embodiment of the speaker system according to the invention.

FIG. 18 shows a sixth embodiment of the speaker system according to the present invention in which a swing plate 47 similar to the swing plate 40 is employed. This embodiment features that the speaker unit 20 is supported to be rotatable about a lateral horizontal shaft 48 which lies in the plane of the swing plate 47. A counter-weight 49 is provided behind the speaker unit in such a manner that the rotation axis of the speaker unit 20 passes through the center of gravity of the body formed by the speaker unit 20 and the counter-weight 49. The swing plate 47 is rotatably supported on the brackets 42 in a manner similar to that shown in FIG. 17.

In this embodiment, the brackets 42 are supported on a rotatable plate 50 which also is rotatably mounted about a horizontal axis on a side wall of the cabinet. By this arrangement, the rotation axis of the swing plate 47 can be maintained to be vertical by rotating the rotatable plate 50 even if the cabinet is inclined with respect to the horizontal plane. Since the center of gravity of the body constituted by the speaker unit 20 and the counter-weight 49 lies on its horizontal rotation axis, a projecting or withdrawing movement of the speaker unit 20 relative to the cabinet, which may be generated if the rotation axis of the swing plate 47 is inclined with respect to the vertical direction, is prevented by adjusting the direction of the brackets 42 to the vertical direction. To rotate the rotatable plate 50, a shaft having a rotation knob 51 which is positioned outside the cabinet is fixed to the rotatable plate 50.

Figure 19:
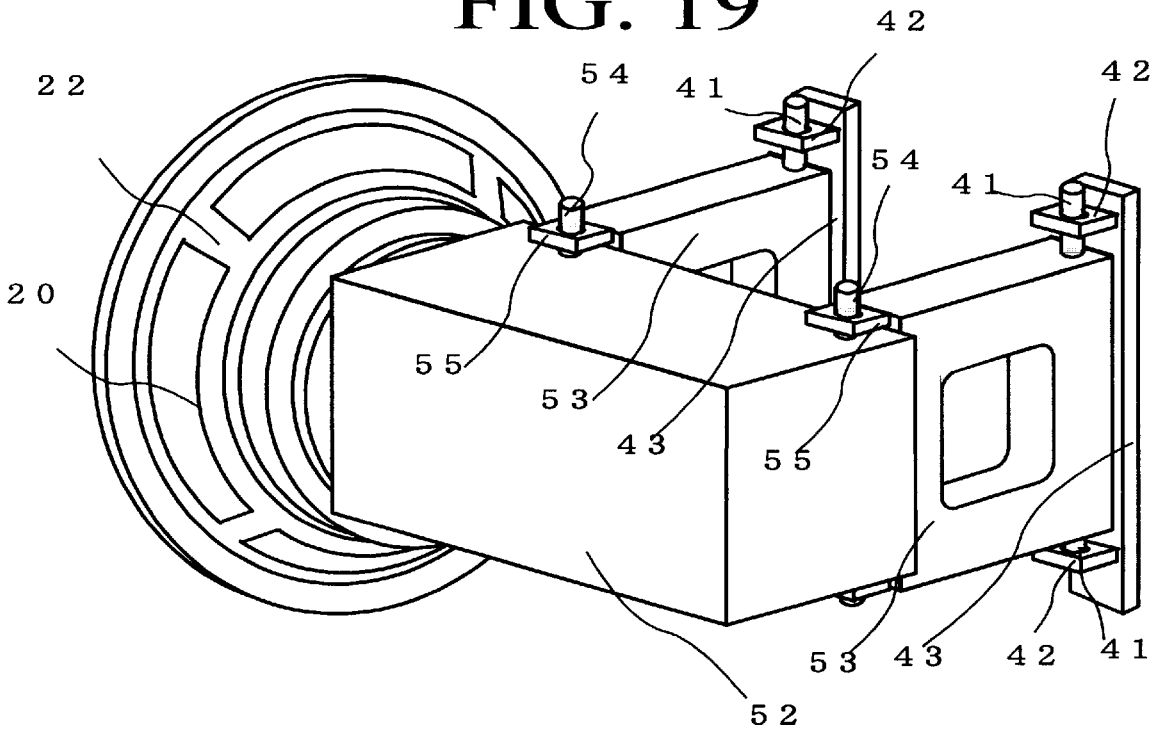
FIG. 19 is a perspective view of the support structure used in a seventh embodiment of the speaker system according to the invention.

FIG. 19 shows a seventh embodiment of the speaker system according to the present invention in which a rear extension block 52 is connected to the speaker unit 20 similar to the rear extension block 25 explained with respect to the first and third embodiments is provided. The other parts of the speaker system are the same as that shown in FIG. 3, only the support structure of the speaker unit being illustrated in FIG. 19.

In this embodiment, the rear extension block 52 is supported at side positions of a pair of parallel rotatable plates 53, each of which is rotatably supported about a vertical axis formed by the support pins 41 and bracket 42 as in the case of the embodiment shown in FIG. 17. Upper and lower support pins 54 are provided on the upper and lower faces of the rear extension block 52, at positions near its side face, and a pair of brackets 55, each having a reception hole, are connected to each of the rotatable plates 53. With this arrangement, the speaker unit 20 and the rear extension block 52 connected thereto are movable in a parallel manner when the pair of parallel rotatable plates 53 are rotated about their vertical axes of rotation.

In the foregoing description, various embodiments of the speaker system according to the present invention have been described. It is readily understood that the freedom of positioning of the speaker system is increased, especially in the case of the fourth and fifth embodiments which allow the installation of the speaker system in an inclined manner. The improvement of the sound quality is attained by the support mechanism according to the invention, even in the case of such an installation orientation.

It is to be understood that various modifications and variations occur to those skilled in the art according to the present invention. For instance, although a cone type speaker unit is shown in the illustrated examples, any other types of speaker units such as a dome speaker or a horn speaker may be mounted by the method according to the present invention. Furthermore, a speaker system in which more than one speaker unit is mounted can be formed according to the present invention.

What is claimed is:

1. A speaker system comprising:

a speaker unit having a frame and magnet assembly;

a cabinet which houses said speaker unit, the cabinet having a baffle plate in which an opening for receiving said speaker unit is formed;

an extension member attached to the speaker unit magnet assembly;

support means in said cabinet for supporting said extension member in a manner to allow displacement of said speaker unit and said extension member in an axial direction of the speaker unit; and a flexible seal member configured to fit into a gap formed between said baffle plate and said speaker unit frame and attached to the baffle plate and to the speaker unit frame.

2. A speaker system as claimed in claim 1, wherein said flexible seal member is a ring-form rubber element having a U-shaped cross-section.

3. A speaker system as claimed in claim 1, further comprising clamping means for holding said extension member immovable with respect to said cabinet, said clamping means having a movable member connectable to said extension member when positioned in a holding position.

4. A speaker system as claimed in claim 3, wherein said clamping means includes a stationary member to which said speaker frame is pressed by means of said movable member, and said movable member of said clamping means is a clamp bolt detachably inserted into a bass-reflex duct of said cabinet.

5. A speaker system as claimed in claim 3, wherein said clamping means movable member is a rotatable tube which is inserted into a bass-reflex duct of said cabinet, and has a projection portion which is engageable with a portion of said extension member.

6. A speaker system as claimed in claim 1, wherein said flexible seal member is fitted into a gap formed between said baffle plate and said frame of said speaker unit.

7. A speaker system as claimed in claim 1, wherein said speaker frame further includes a sub-baffle plate having an opening in which said speaker unit is received, said sub-baffle plate being placed at a position of said opening of said baffle plate, and wherein said flexible seal member is fitted into a gap formed between said baffle plate and said sub-baffle plate.

8. A speaker system as claimed in claim 1, wherein said extension member is fixed to said magnetic circuit of said speaker unit, and said support means comprises a plurality of link members, each having an end rotatably connected to said extension member and another end at which said link member is rotatably supported about a rotation axis.

9. A speaker system as claimed in claim 8, wherein said rotation axis at which said link member is rotatably supported lies horizontally.

10. A speaker system as claimed in claim 8, wherein said rotation axis at which said link member is rotatably supported lies vertically.

11. A speaker system as claimed in claim 8, wherein said support means further comprises a support frame on which said plurality of link members connected to said extension member are supported, said support frame being placed on a base plate of said cabinet.

12. A speaker system as claimed in claim 11, wherein said support frame comprises a stationary base part and a movable part on which said rotation axes of said link members are placed, said movable part is supported by a plurality of rotatable connection members which are rotatably supported on said stationary base, wherein the effective lengths of said rotatable connection members and said link members are made equal to each other, and a height level at which the rotatable connection members are connected to said stationary base part is made equal to a height level at which said link members are rotatably connected to said extension part, so that the position of said movable part with respect to said cabinet can be made unchanged by appropriately rotating said rotatable connection members.

13. A speaker system as claimed in claim 1, wherein said speaker frame includes a swingable member rotatable about a vertical rotation axis, to which said speaker unit is connected.

14. A speaker system as claimed in claim 13, wherein said speaker frame further includes a counter-weight fixed to said speaker unit, wherein said swingable member is rotatably connected to said speaker unit and said counter-weight fixed together, at a position where the axis of rotation of said swingable member relative to said speaker unit and said counter-weight passes through the center of gravity of a body constituted by said speaker unit and said counter-weight, and wherein said swingable member is supported by a rotatable member on which a pair of support members for rotatably supporting said swingable member are fixed, said rotatable member being rotatably provided in said cabinet so that the direction of a line connecting said pair of support members can be maintained vertical by rotating said rotatable member when said cabinet is angularly displaced from a horizontal plane.

15. A speaker system as claimed in claim 1, wherein said support means is shiftable within in said cabinet within a plane parallel to a base plate of said speaker unit and transverse to a center axis of the speaker unit, such that the center axis of the speaker unit is not normal to the baffle plate.

16. A speaker system as claimed in claim 1, wherein the flexible seal member fits into a gap formed along an inner edge of the baffle plate opening between the baffle plate and an outer periphery of the speaker frame.

17. A speaker system as claimed in claim 1, wherein said flexible seal member is a ring-form rubber element having a round cross-section.

18. A speaker system including a speaker unit, said speaker system comprising:

an isolated part including said speaker unit;

a cabinet which houses said isolated part including said speaker unit, having a baffle plate in which an opening for receiving said speaker unit is formed;

support means positioned in said cabinet for supporting said isolated part including said speaker unit in a manner to substantially isolate vibration of said speaker unit in an axial direction of the speaker unit, from said cabinet; and a flexible seal member configured to fit into a gap formed between said baffle plate and said isolated part and attached to the baffle plate and to the speaker unit frame.

19. A speaker system as claimed in claim 18, wherein said isolated part includes an extension part fixed to said magnetic circuit of said speaker unit, and said support means comprises a frame and a support member made of a vibration isolation material mounted on said frame.

20. A speaker system as claimed in claim 18, wherein the flexible seal member fits into a gap formed along an inner edge of the baffle plate opening between the baffle plate and an outer periphery of the speaker frame.

21. A speaker system comprising:

a speaker unit having a frame and magnet assembly;

a cabinet which houses said speaker unit, the cabinet having a baffle plate in which an opening for receiving said speaker unit is formed;

an extension member attached to the speaker unit magnet assembly;

support means in said cabinet for supporting said extension member in a manner to allow displacement of said speaker unit and said extension member in an axial direction of the speaker unit;

a flexible seal member configured to fit into a gap formed between said baffle plate and said speaker unit frame; and clamping means for holding said extension member immovable with respect to said cabinet, said clamping means having a movable member connectable to said extension member when positioned in a holding position.

22. A speaker system comprising:

a speaker unit having a frame and magnet assembly;

a cabinet which houses said speaker unit, the cabinet having a baffle plate in which an opening for receiving said speaker unit is formed;

an extension member attached to the speaker unit magnet assembly;

support means in said cabinet for supporting said extension member in a manner to allow displacement of said speaker unit and said extension member in an axial direction of the speaker unit; and a flexible seal member configured to fit into a gap formed between said baffle plate and said speaker unit frame;

said speaker frame further including a sub-baffle plate having an opening in which said one speaker unit is received, said sub-baffle plate being placed at a position of said opening of said baffle plate, and wherein said flexible seal member is fitted into a gap formed between said baffle plate and said sub-baffle plate.

23. A speaker system comprising:

a speaker unit having a frame and magnet assembly;

a cabinet which houses said speaker unit, the cabinet having a baffle plate in which an opening for receiving said speaker unit is formed;

an extension member attached to the speaker unit magnet assembly;

support means in said cabinet for supporting said extension member in a manner to allow displacement of said speaker unit and said extension member in an axial direction of the speaker unit, said extension member being fixed to said magnetic circuit of said speaker unit, and said support means comprising a plurality of link members, each having an end rotatably connected to said extension member and another end at which said link member is rotatably supported about a rotation axis; and a flexible seal member configured to fit into a gap formed between said baffle plate and said speaker unit frame.

24. A speaker system comprising:

a speaker unit having a frame and magnet assembly, said speaker frame including a swingable member rotatable about a vertical rotation axis, to which said speaker unit is connected, said speaker frame further including a counter-weight fixed to said speaker unit, wherein said swingable member is rotatably connected to said speaker unit and said counter-weight fixed together, at a position where the axis of rotation of said swingable member relative to said speaker unit and said counter-weight passes through the center of gravity of a body constituted by said speaker unit and said counter-weight, and wherein said swingable member is supported by a rotatable member on which a pair of support members for rotatably supporting said swingable member are fixed;

a cabinet which houses said speaker unit, the cabinet having a baffle plate in which an opening for receiving said speaker unit is formed, said rotatable member being rotatably provided in said cabinet so that the direction of a line connecting said pair of support members can be maintained vertical by rotating said rotatable member when said cabinet is angularly displaced from a horizontal plane;

an extension member attached to the speaker unit magnet assembly;

support means in said cabinet for supporting said extension member in a manner to allow displacement of said speaker unit and said extension member in an axial direction of the speaker unit; and a flexible seal member configured to fit into a gap formed between said baffle plate and said speaker unit frame.

25. A speaker system comprising:

a speaker unit having a frame and magnet assembly;

a cabinet which houses said speaker unit, the cabinet having a baffle plate in which an opening for receiving said speaker unit is formed;

an extension member attached to the speaker unit magnet assembly;

support means in said cabinet for supporting said extension member in a manner to allow displacement of said speaker unit and said extension member in an axial direction of the speaker unit, said support means being shiftable within in said cabinet within a plane parallel to a base plate of said speaker unit and transverse to a center axis of the speaker unit, such that the center axis of the speaker unit is not normal to the baffle plate; and a flexible seal member configured to fit into a gap formed between said baffle plate and said speaker unit frame.

* * * * *